US011197529B2

(12) United States Patent
Sanchez et al.

(10) Patent No.: US 11,197,529 B2
(45) Date of Patent: Dec. 14, 2021

(54) APPLICATOR FOR APPLYING A PRODUCT TO THE EYELASHES AND/OR EYEBROWS

(71) Applicant: L'OREAL, Paris (FR)

(72) Inventors: Marcel Sanchez, Aulnay Sous Bois (FR); Eric Caulier, Maignelay (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 187 days.

(21) Appl. No.: 14/787,116

(22) PCT Filed: Apr. 18, 2014

(86) PCT No.: PCT/IB2014/060845
§ 371 (c)(1),
(2) Date: Oct. 26, 2015

(87) PCT Pub. No.: WO2014/174424
PCT Pub. Date: Oct. 30, 2014

(65) Prior Publication Data

US 2016/0073767 A1 Mar. 17, 2016

(30) Foreign Application Priority Data

Apr. 26, 2013 (FR) ..... 13 53882

(51) Int. Cl.
*A45D 40/26* (2006.01)
*A46D 1/00* (2006.01)
*A46B 9/02* (2006.01)

(52) U.S. Cl.
CPC ..... *A45D 40/265* (2013.01); *A46B 9/021* (2013.01); *A46D 1/0276* (2013.01); *A46B 2200/1053* (2013.01)

(58) Field of Classification Search
CPC ..... A45D 33/003; A45D 33/26; A45D 40/24; A45D 40/265; A45D 40/262;
(Continued)

(56) References Cited

U.S. PATENT DOCUMENTS 1,004,371 A * 9/1911 Cohen ..... A45D 20/48 132/118
1,197,872 A * 9/1916 Taylor ..... A45D 20/48 132/118
(Continued)

FOREIGN PATENT DOCUMENTS

EP 1070466 A2 1/2001
FR 2837077 A1 9/2003
(Continued)

OTHER PUBLICATIONS

Jun. 11, 2014 International Search Report issued in International Patent Application No. PCT/IB2014/060845.
(Continued)

*Primary Examiner* — Yogesh P Patel
*Assistant Examiner* — Jennifer Gill
(74) *Attorney, Agent, or Firm* — Oliff PLC

(57) ABSTRACT

The present invention relates to an applicator (2) for applying a product (P) to the eyelashes and/or eyebrows, having moulded applicator member (8), this applicator member having: —a core (10) that extends along a longitudinal axis (X), and—teeth (20) that narrow in front view in the direction of their free end and have at least one edge having a point of inflection.

13 Claims, 4 Drawing Sheets

(58) Field of Classification Search
CPC ..... A45D 40/267; A46B 2200/1053; A46B 2200/106; A46B 9/021; A46B 9/023; A46B 9/025
USPC ..... 132/218, 314, 319; 15/186–188
See application file for complete search history.

(56) References Cited

U.S. PATENT DOCUMENTS 1,282,070 A * 10/1918 Green ..... A45D 20/48 132/118
1,510,217 A * 9/1924 Goldberg ..... A45D 20/525 132/125
2,484,133 A * 10/1949 Von Duyke ..... A45D 24/22 132/113
2,545,885 A * 3/1951 Jackson ..... A45D 20/48 132/118
2,596,296 A * 5/1952 Shields ..... A45D 24/24 132/108
3,103,027 A * 9/1963 Birch ..... A46B 15/00 15/110
3,230,562 A * 1/1966 Birch ..... A46B 15/00 15/110
3,416,543 A * 12/1968 Hantman ..... A45D 24/02 132/125
4,126,143 A * 11/1978 Schroeder ..... A45D 20/48 132/118
D253,849 S * 1/1980 Schroeder ..... D28/24
4,869,612 A * 9/1989 Mooney ..... A45D 34/04 132/317
5,657,775 A * 8/1997 Chou ..... A46B 7/04 132/125
5,771,904 A * 6/1998 Lange ..... A46D 1/00 132/144
D634,127 S * 3/2011 Burgess ..... A46B 9/021 D4/128
D677,904 S * 3/2013 Hammer ..... D4/128
D678,683 S * 3/2013 Hammer ..... D4/128
9,032,972 B2 * 5/2015 Viegas ..... A45D 40/262 132/218
D757,445 S * 5/2016 Rutigliano ..... D4/128
2001/0047808 A1 * 12/2001 Gueret ..... A46B 9/021 132/218
2002/0020424 A1 * 2/2002 Gueret ..... A46B 9/021 132/218
2003/0163884 A1 9/2003 Weihrauch
2005/0160546 A1 * 7/2005 Weihrauch ..... A46B 15/001 15/207.2
2005/0217691 A1 * 10/2005 Petit ..... A45D 40/265 132/320
2007/0062551 A1 3/2007 De Brouwer et al.
2007/0151571 A1 * 7/2007 Byun ..... A45D 19/02 132/108
2008/0105270 A1 * 5/2008 Walters ..... A46B 9/023 132/112
2008/0314403 A1 * 12/2008 Rebours ..... A45D 40/262 132/218
2009/0083925 A1 4/2009 Mathiez
2011/0094534 A1 * 4/2011 Bickford ..... A45D 34/045 132/218
2011/0229246 A1 * 9/2011 Kulik ..... A45D 40/262 401/129
2012/0170965 A1 * 7/2012 Kulik ..... A46B 9/021 401/121
2012/0192892 A1 8/2012 Kulik
2012/0192893 A1 8/2012 Anderson
2014/0003857 A1 * 1/2014 Gueret ..... A45D 40/262 401/129
2015/0110541 A1 * 4/2015 Uresti ..... A46B 3/005 401/129

FOREIGN PATENT DOCUMENTS

FR 2922422 A1 4/2009
FR 2961384 A1 12/2011
WO 2010/013213 A2 2/2010
WO 2010/098512 A1 9/2010

OTHER PUBLICATIONS

Jul. 5, 2018 Office Action issued in Japanese Patent Application No. 2016-509575.

* cited by examiner

APPLICATOR FOR APPLYING A PRODUCT TO THE EYELASHES AND/OR EYEBROWS

FIELD OF THE INVENTION

The present invention relates to an applicator for applying a product to the eyelashes and/or eyebrows, having a moulded applicator member, and to a packaging and application device comprising such an applicator.

BACKGROUND OF THE INVENTION

Numerous applicators having an applicator member that has a core and teeth moulded in one piece with the core have already been proposed.

Applications EP 1 070 466 and FR 2 837 077 disclose a comb having two rows of teeth, the teeth in each row having a flattened cross section that tapers towards their free end. Application FR 2 837 077 describes in particular teeth having an overall shape in the form of a zigzag, the changes in direction of each tooth forming hollows and protuberances that are able to retain product.

Applications FR 2 961 384 and FR 2 922 422 disclose a brush having teeth with asymmetric shapes in front view, having a first longitudinal face with a flat shape and a second longitudinal face with a rounded, in particular convex, shape, the teeth tapering towards their free end.

US 2007/0062551 and US 2012/0192892 disclose mascara applicators having teeth which are not symmetrical in shape in front view.

US 2003/0163884 discloses a mascara applicator having teeth which do not present any point of inflection.

There is a need to further improve applicators having a moulded applicator member in order to allow the user to apply makeup such that the eyelashes are loaded and separated as effectively as possible.

There is also a need to benefit from an applicator that makes it possible to apply makeup to the eyelashes or eyebrows, which are or are not already coated with product, by bunches.

SUMMARY OF THE INVENTION

A subject of the invention, according to one of its aspects, is an applicator for applying a product to the eyelashes and/or eyebrows, having a moulded applicator member, this applicator member having:

- a core that extends along a longitudinal axis, and
- teeth that narrow in front view in the direction of their free end and have at least one edge having a point of inflection.

Such a tooth shape makes it possible, when the brush is used with a cosmetic product, in particular mascara, to prevent excessive retention of product on the teeth, and to have a relatively large contact surface between the teeth and the eyelashes and/or eyebrows, this making it possible, during application, to adequately load the latter with product.

The fact that the teeth narrow in front view in the direction of their free end and have an edge having a point of inflection also promotes the separation of the row of eyelashes, in order to obtain, during the application of the product or during combing, a multitude of bunches of eyelashes that are well defined and to prevent the formation of excessively large clumps of eyelashes.

The presence of the point of inflection ensures progressiveness in the contact with the eyelash, avoiding the presence of ridges.

The expression "longitudinal axis of the core" denotes the line connecting all of the centres of mass of the cross sections of the core. The longitudinal axis may be a central axis, or even an axis of symmetry for the core, in particular when the core has a circular cross section or a cross section in the overall shape of a regular polygon. The longitudinal axis of the core may be rectilinear or curved and may be contained in a plane, which may be a plane of symmetry for some, or even for all of the cross sections of the core. Preferably, the longitudinal axis of the core is rectilinear.

The term "tooth" denotes an individualizable projecting element which serves to apply the product and to separate the eyelashes and/or eyebrows, extends along a longitudinal axis, defined by the largest dimension of the tooth perpendicular to the longitudinal axis of the core, and is produced in accordance with the invention. In front view, a tooth has two opposite edges that meet at its free end, in particular at the mid-plane of the tooth.

The teeth may have a bottom part and a top part, the point(s) of inflection being located in the top part, which corresponds in particular to the upper half of the teeth. In the bottom part, the edges of the teeth are preferably formed by a rectilinear portion. The rectilinear portions of the edges are advantageously parallel to one another. In one variant, the rectilinear portions of the edges are not parallel to one another, and converge towards or diverge away from one another in the direction of the free end of the teeth.

The expression "front view" denotes the projection of a tooth onto a plane defined by the longitudinal axis of said tooth and the axis of its largest dimension in cross section. When the tooth is axisymmetrical, the front view is defined as the projection onto any longitudinal plane of the tooth. When the tooth has a flattened overall shape, the front view corresponds to a projection of the tooth in a direction perpendicular to its flattening plane.

The expression "the teeth narrow in the direction of their free end" should be understood as meaning that the width of the teeth, measured perpendicularly to their longitudinal axis, decreases towards the top in the direction of their free end.

The expression "the teeth have at least one edge having a point of inflection" denotes teeth that are produced such that, when they are viewed in front view, at least one of their edges, which follows a curve along at least a portion of its length, changes concavity at one point, known as the point of inflection. The tangent at this point then crosses the curve followed by said edge.

The teeth thus advantageously have no ridge in the region of the curved edge, this making it possible to avoid the situation in which product remains stuck and clings to certain parts of the teeth.

The gradient of the point of inflection, that is to say the angle formed between the tangent, at this point, to the curve followed by the edge having the point of inflection and the longitudinal axis of the tooth, may be between 30° and 80°.

The teeth may have two opposite edges, each having a point of inflection.

The teeth preferably have a symmetric shape in front view. In this case, the two opposite edges of the teeth each have a point of inflection having the same gradient and produced at the same axial position on the tooth.

In one variant, the teeth have an asymmetric shape in front view. The teeth may in particular have a single edge having a point of inflection. As a variant, the two opposite edges of the teeth each have a point of inflection, but have different gradients and are produced at different axial positions on the tooth.

The point of inflection may be located half-way from the mid-plane of the teeth and the lateral plane farthest away from this mid-plane, parallel to the mid-plane and resting on the tooth on the same side as the point of inflection.

The teeth are advantageously disposed on the core in one or more longitudinal rows. The teeth of one row may be aligned with or offset with respect to one another, being in particular arranged in staggered rows.

Preferably, the rows are distributed equally around the core.

Within one row, the teeth may be disposed perpendicularly to the longitudinal axis of the core. In one variant, the teeth are disposed obliquely with respect to the longitudinal axis of the core.

The teeth may extend along a longitudinal axis oriented perpendicularly to the longitudinal axis of the core. In one variant, the teeth extend along a longitudinal axis oriented obliquely with respect to the longitudinal axis of the core.

The spacing between the teeth within a single longitudinal row may be constant. In one variant, the spacing between the teeth within a single longitudinal row is variable.

The teeth narrow preferably only in their top part.

The greatest width of a tooth, in front view, may be less than or equal to 4 mm, better still less than or equal to 3 mm, even better still less than or equal to 2 mm. It is preferably located in the bottom part of the tooth.

In another embodiment, the width of a tooth in the bottom part of said tooth may be strictly inferior to the greatest width of said tooth.

The height of the teeth may be less than or equal to 5 mm, better still less than or equal to 3 mm, the height of the teeth being their dimension along their longitudinal axis.

The teeth may all be the same height. In one variant, the teeth have a variable height. In this case, the height of the top part of the teeth may be constant from one tooth to another and that of their lower part may be variable, being in particular between 0 mm and 5 mm, better still between 1 mm and 4 mm.

The teeth may have a flattened cross section, that is to say that they have, over at least a part of their height, a cross section, measured perpendicularly to their direction of elongation, which has an elongate shape in a flattening plane, that is to say is wider than it is thick. The flattening plane of the teeth may form an angle of between 60° and 120° with the longitudinal axis of the core, the flattening plane being preferably perpendicular to the longitudinal axis of the core. In one variant, the flattening plane of the teeth forms a zero angle with the longitudinal axis of the core.

The ratio of the width of the teeth to their thickness may thus be greater than or equal to 2, better still greater than or equal to 3.

The teeth may also become thinner, in side view, in the direction of their free end over at least a part of their height, in particular in their top part, that is to say that their thickness, measured perpendicularly to their longitudinal axis, decreases towards the top in the direction of their free end.

The expression "side view" denotes the projection of a tooth onto a plane at right angles to its flattening plane and parallel to its longitudinal axis.

The greatest thickness of a tooth may be between 0.2 mm and 1 mm, better still between 0.4 mm and 0.8 mm, this greatest thickness being, in cross section, the dimension of the tooth in the direction at right angles to the direction of its greatest width. The thickness of a tooth may be measured parallel to the longitudinal axis of the core when the flattening plane of the tooth is perpendicular to the longitudinal axis of the tooth. The greatest thickness of a tooth may be located at its base, in particular when the tooth becomes thinner in the direction of its free end.

In their bottom part, the teeth may have a circular, ovoid or polygonal, for example rectangular, cross section.

The two opposite edges of the teeth may each have a ridge at the junction between the top part and the bottom part.

The teeth may have at least one notch, in particular at their free end. This notch may be in the form of a small opening that extends from the interior of the tooth towards its periphery. Preferably, the notch or notches is/are through-notches. The notch or notches is/are preferably visible when the tooth is viewed from the front. The notch or notches is/are preferably produced in the flattening plane of the teeth.

The teeth may all be identical, give or take one homothetic transformation, if need be.

The teeth are preferably moulded together with at least a part of the core, better still with all of the core. The tooth may be made of the same material as a part of the core, better still all of the core. The tooth may thus be injection-moulded from thermoplastic material with at least a part of the core, better still all of the core.

In one variant, the teeth and the core are made of different materials, for example by bi-injection moulding. The teeth are for example moulded through openings in the core. The teeth may be produced from a material softer than the core or, as a variant, harder than the core.

The core may have a circular or polygonal, in particular hexagonal, cross section. The teeth may be attached to one and the same flat face of the core over more than half of their greatest width. Preferably, the teeth extend over virtually their entire width, at their base, from one and the same flat face of the core.

In one variant, the core is twisted.

The applicator member may have spikes which may be positioned between the teeth. In an embodiment, the teeth and the spikes may be disposed in a row of teeth and spikes in an alternate manner. In a row, each tooth may succeed to a spike.

In an embodiment, the teeth may extend from branches which may be relied to the core at one or each of their ends. The applicator may comprise branches each carrying a row of teeth, in particular a row of teeth and spikes as described above. The applicator may comprise 2 to 10 branches, more particularly 4 to 8 branches, for example 6 branches. A branch may carry 5 to 30 teeth, in particular 8 to 20 teeth, for example 10 teeth. A branch may carry 5 to 30 spikes, in particular 8 to 20 spikes, for example 12 spikes.

A further subject of the invention is a packaging and application device having:

- an applicator according to the invention, as defined above,
- a container containing a product to be applied to the eyelashes and/or eyebrows with the aid of the applicator.

The gripping member of the applicator may form a cap for closing the container in a sealed manner.

The container may have a member for wiping the applicator.

The product to be applied may be a mascara or a care product.

A further subject of the invention is a method for making up the eyelashes and/or eyebrows with the aid of an applicator according to the invention.

BRIEF DESCRIPTION OF THE DRAWINGS

The invention may be better understood on reading the following detailed description of non-limiting illustrative examples thereof and on examining the appended drawing, in which.

DETAILED DESCRIPTION OF PREFERRED EMBODIMENTS

Figure 1:
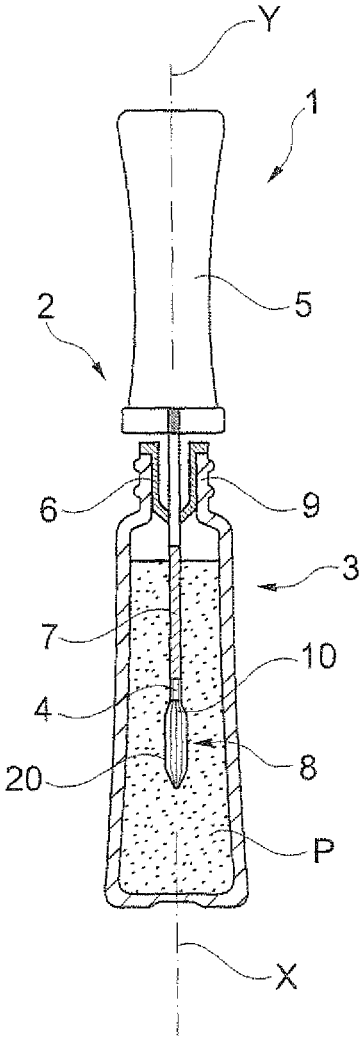
FIG. 1 is a schematic and partial view, in longitudinal section, of an example of a packaging and application device produced in accordance with the invention.

The packaging and application device 1 shown in FIG. 1 has a container 3 containing a product P to be applied to the eyelashes and/or eyebrows and an applicator 2 for applying said product P, which may be fixed removably to the container 3.

The applicator 2 has an applicator member 8 according to the invention, which will be described in detail below, said applicator member 8 being connected by a stem 7 to a gripping member 5 which also forms a member for closing the container 3. This closure member 5 is, for example, as illustrated, a cap designed to be screwed onto a threaded neck 9 of the container in order to close the latter in a sealed manner. In a variant, the applicator 2 can be fixed to the container 3 in some other way.

The neck 9 may accommodate, as illustrated, a wiping member 6 which is for example inserted into the neck 9. This wiping member 6 has for example a lip that defines a wiping orifice having a diameter adapted to that of the stem 7. The wiping member 6 may be of any type, connected to the container 3 or moulded together therewith. The wiping member 6 may also be adjustable. In a variant, the neck 9 of the container 3 may be attached.

In the example illustrated, the stem 7 has a rectilinear longitudinal axis Y, but if the stem 7 is not rectilinear, this does not depart from the scope of the present invention. The stem 7 may have a flexible part at its distal end, optionally provided with an annular groove, the applicator member 8 then being attached to this flexible part.

The product P is intended to be applied to the eyelashes and/or eyebrows. It may comprise iron oxide, among other pigments, and an aqueous or organic solvent, depending on the formulation.

If need be, the stem 7 may have an annular narrowing at its portion that is positioned opposite the lip of the wiping member 6, so as not to mechanically stress the latter unduly during storage of the applicator 2 in the container 3.

The applicator member 8 may be connected to the stem 7 in various ways and has for example, as illustrated, an end piece 4 designed to be fixed in a housing thereof.

The applicator member 8 may be fixed to the stem 7 by any means, and in particular by force-fitting, stapling, snap-fastening, adhesive bonding, welding or crimping, in the corresponding housing provided at the end of the stem 7. As a variant, the stem 7 may be inserted into a housing provided in the core 10, or the stem and the core may be produced at least partly in one piece, for example by moulding of material.

The applicator member 8 has a core 10 carrying teeth 20.

The core 10 has an elongate shape along a longitudinal axis X, which may be rectilinear or curved, preferably being rectilinear, and which may be central.

The core 10 may have a circular or polygonal, in particular hexagonal, cross section along the majority of its length. The teeth 20 may extend all around the core 10. In one variant, only a part of the core 10 carries teeth 20.

The core 10 may be made of a thermoplastic material which is or is not relatively rigid, for example SEBS, a silicone, latex, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, PET, POM, PA or PMMA. It is possible in particular to use the materials known under the trade names Hytrel®, Cariflex®, Alixine®, Santoprene®, Pebax®, this list not being limiting.

The core 10 may be twisted, the teeth 20 then following the twist produced by the core.

The teeth 20 each extend outwardly from the core 10, in the direction of a free end 26, along a longitudinal axis Z.

The teeth 20 are preferably made of the same material as at least a part of the core 10, better still all of the core 10. The teeth 20 are preferably produced in one piece with the core 10 by moulding of thermoplastic material.

In one variant, the teeth 20 and the core 10 are made of different materials. The teeth 20 are for example moulded through openings in the core 10. The teeth 20 may be produced from a material softer than the core or, as a variant, harder than the core.

The teeth 20 have a bottom part 21 and a top part 22. The teeth 20 have two opposite edges 24, 25 that meet at the free end 26 of the teeth.

Figure 2:
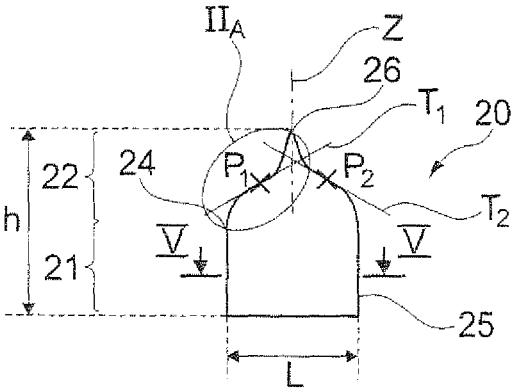
FIG. 2 is a schematic view of a tooth according to the invention, on its own and viewed in front view.

As illustrated in FIG. 2, the teeth 20 according to the invention narrow in front view in the direction of their free end 26, along their top part 22, that is to say that the width of the teeth 20 decreases towards the top.

The greatest width L of each tooth 20, defined as the largest dimension of the tooth 20 measured perpendicularly to its longitudinal axis Z, may be between 1 mm and 4 mm, better still between 1.5 mm and 3 mm. This greatest width L is preferably measured from the base of the teeth 20, as illustrated in FIG. 2.

Preferably, and as illustrated in FIG. 2, the free end 26 of each tooth 20 is tapered in front view, forming in particular a point which makes it easier for the applicator member 8 to penetrate into the eyelashes and to separate the latter.

Figure 2A:
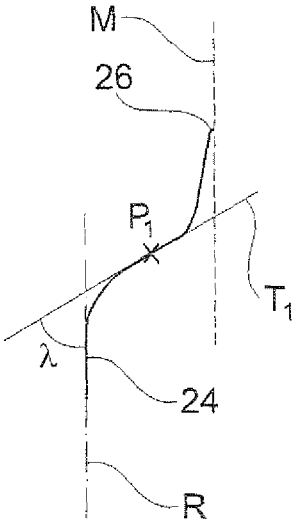
FIG. 2A is a detail of the tooth from FIG. 2, FIGS. 3 and 4 are views similar to FIG. 2 of variant embodiments of teeth.

In the example shown in FIGS. 2 and 2A, the edges 24 and 25 of the teeth 20 are formed, in their bottom part 21, by rectilinear portions, and each follow a curve, over the top part 22, that changes concavity, respectively, at points $P_1$ and $P_2$, known as points of inflection. The tangent at each point $P_1$ and $P_2$ thus crosses the curve followed by the edge 24, as can be seen in particular in FIG. 2A.

The gradient of the point of inflection $P_1$, that is to say the angle A formed between the tangent $T_1$, at this point, to the curve followed by the edge 24 and the axis Z, may be between 30° and 60°, the adjacent edge being of axis R parallel to the axis Z in FIG. 2A.

In the example in FIGS. 2 and 2A, the point of the inflection $P_1$ is located approximately half-way from the mid-plane M of the tooth 20 and the parallel plane containing the axis R.

In the example illustrated in FIG. 2, the points of inflection of the two edges 24 and 25 have the same gradient and are produced at the same axial position on the tooth. The tooth 20 thus has a symmetric shape in front view.

Figure 3:
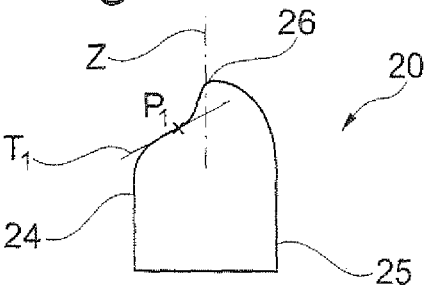
Figure 4:
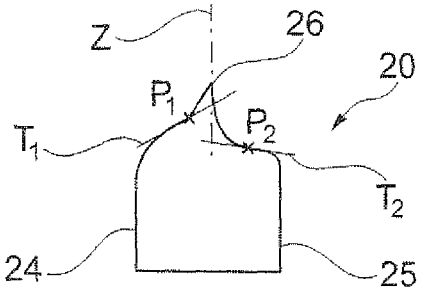

As a variant, the tooth 20 has an asymmetric shape in front view, only the edge 24 having a point of inflection, as shown in FIG. 3, or the two opposite edges 24, 25 of the tooth 20 each having a point of inflection but with different gradients and produced at different axial positions on the tooth, as shown in FIG. 4.

Figure 5A:
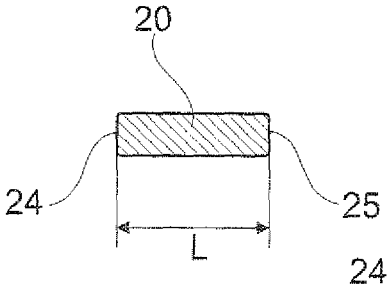
FIG. 5A is a cross section on V-V of the tooth from FIG. 2, FIGS. 5B to 5C are views similar to FIG. 5A of variant embodiments.
Figure 5B:
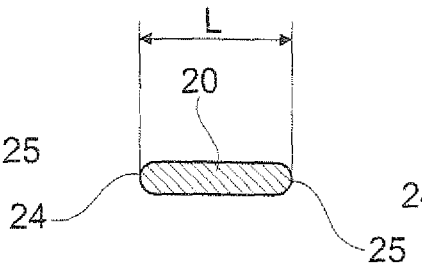
Figure 5C:
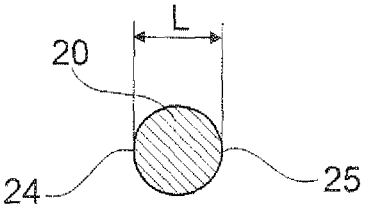

The teeth 20 may have a cross section of any shape in their bottom part 21, for example a rectangular cross section, as illustrated in FIG. 5A, an ovoid cross section, as illustrated in FIG. 5B, or a circular cross section, as illustrated in FIG. 5C.

FIGS. 6 to 9 show the applicator member 8 in a top view, that is to say in a projection onto a plane parallel to the longitudinal axis X of the core 10 and perpendicular to the longitudinal axis Z of the teeth 20.

As illustrated in these figures, each tooth 20 has a cross section flattened along a flattening plane W that is oriented perpendicularly to the longitudinal axis X of the core 10. The ratio L/l of the greatest width L of the teeth 20 to their greatest thickness l may be greater than or equal to 2, better still greater than or equal to 3.

The teeth 20 may also become thinner, in side view, in the direction of their free end 26 over at least a part of their height, in particular in their top part 22, that is to say that their thickness, measured perpendicularly to their longitudinal axis Z, decreases towards the top in the direction of their free end.

The greatest thickness l of each tooth 20 may be between 0.2 mm and 1 mm, better still between 0.4 mm and 0.8 mm. The thickness of each tooth 20 half-way up may be less than or equal to 0.5 mm.

As illustrated in FIGS. 6 to 11, the teeth 20 are disposed on the core 10 in at least one longitudinal row 30. In the example illustrated in FIG. 6, the teeth 20 in the row 30 are aligned strictly with one another. In the variant in FIG. 7, the teeth 20 are offset with respect to one another within the row 30, being arranged in staggered rows.

Figure 6:
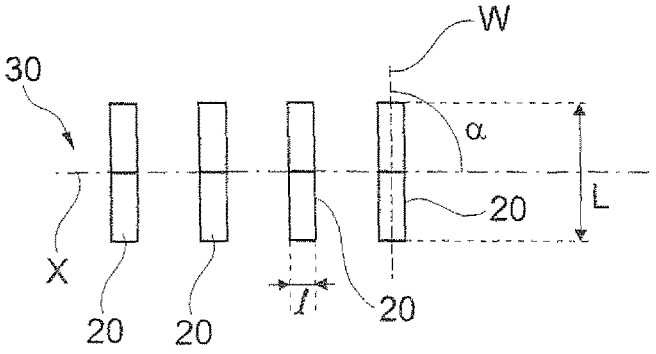
FIGS. 6 to 9 are schematic and partial top views of applicator members according to the invention.
Figure 7:
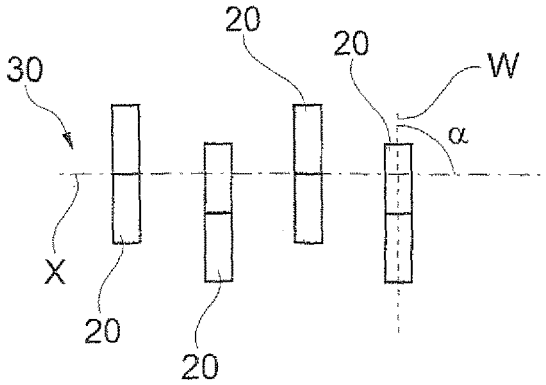
Figure 8:
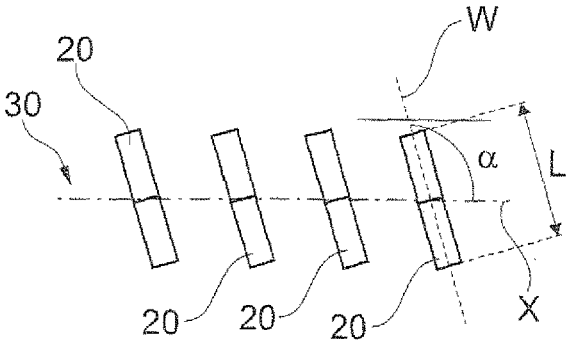
Figure 9:
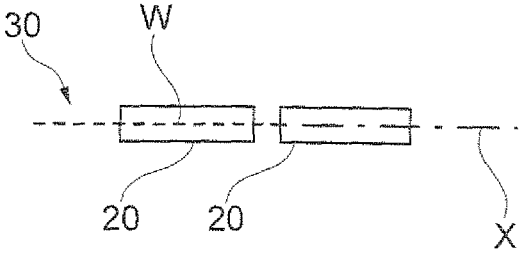
Figure 10:
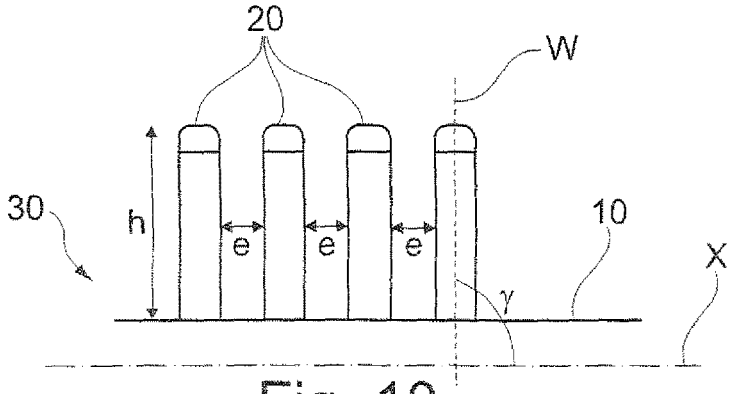
FIGS. 10 to 12 are schematic side views illustrating different variants of the relative positioning of successive teeth.
Figure 11:
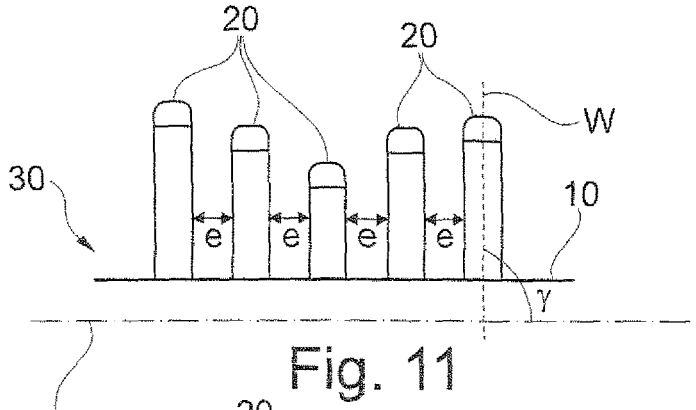

The flattening plane W of the teeth 20 may form, in top view, as illustrated in FIGS. 6 to 8, an angle α with the longitudinal axis X of the core 10 and, in side view, as illustrated in FIGS. 9 to 11, an angle γ with the longitudinal axis X of the core 10. The angles α and γ are preferably between 60° and 120°.

As illustrated in FIGS. 6 and 7, the teeth 20 are preferably perpendicular to the longitudinal axis X of the core 10, the angles α and γ being equal to 90°.

In a variant illustrated in FIG. 8, the teeth 20 are oblique with respect to the longitudinal axis X of the core 10, the angle α being other than 90° and the angle γ being equal to 90°.

In a further variant, illustrated in FIG. 9, the flattening plane W of the teeth 20 extends along the longitudinal axis X of the core 10, the angle α being zero.

In a variant which is not illustrated, the teeth 20 are inclined with respect to the longitudinal axis X of the core 10, the angle α being equal to 90° and the angle γ being other than 90°.

In the example in FIG. 10, the teeth 20 in the longitudinal row 30 are all the same height h, which is their dimension along their longitudinal axis Z.

In a variant shown in FIG. 11, the teeth 20 have a variable height h. In this case, the height of the top part 22 is constant from one tooth to another and that of the lower part 21 is variable, being in particular between 0.5 mm and 5 mm, better still between 1 mm and 4 mm.

The height h of each tooth 20 may be less than or equal to 5 mm, better still less than or equal to 3 mm.

Figure 12:
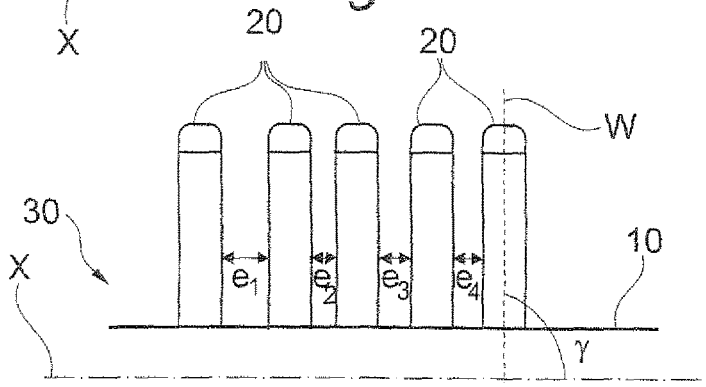

In the examples described above, the spacing e between the teeth 20 within a single longitudinal row 30 is constant. In a variant shown in FIG. 12, the spacing between the teeth 20 is variable.

Figure 13:
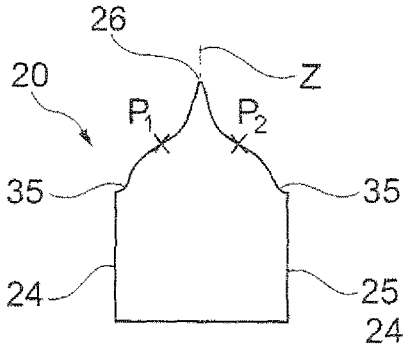
FIGS. 13 to 15 are views similar to FIG. 2 of variant embodiments of teeth according to the invention.

As shown in FIG. 13, the edges 24 and 25 of the tooth 20 may each have a ridge 35 at the junction between the top part 22 and the bottom part 21. In a variant, this ridge is absent.

Figure 14:
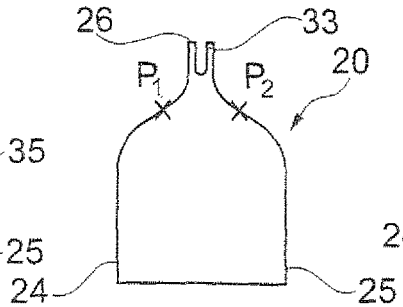

In the variant embodiment illustrated in FIG. 14, the teeth 20 have a notch 33, which is for example in the form of a small opening that extends from the interior of the tooth towards its periphery, in the region of the end 26. The notch 33 is a through-notch. In a variant which is not illustrated, the teeth 20 have a plurality of notches. The number, shape and/or position of these notches may vary from one tooth 20 to another.

In a variant which is not illustrated, the teeth 20 have at least one recess and/or depression in their surface, and/or have an opening passing through them, for example an opening having an axis perpendicular to their flattening plane W. The teeth may be flocked, at least in part.

Figure 15:
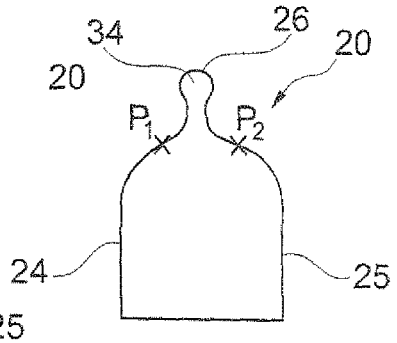
Figure 16:
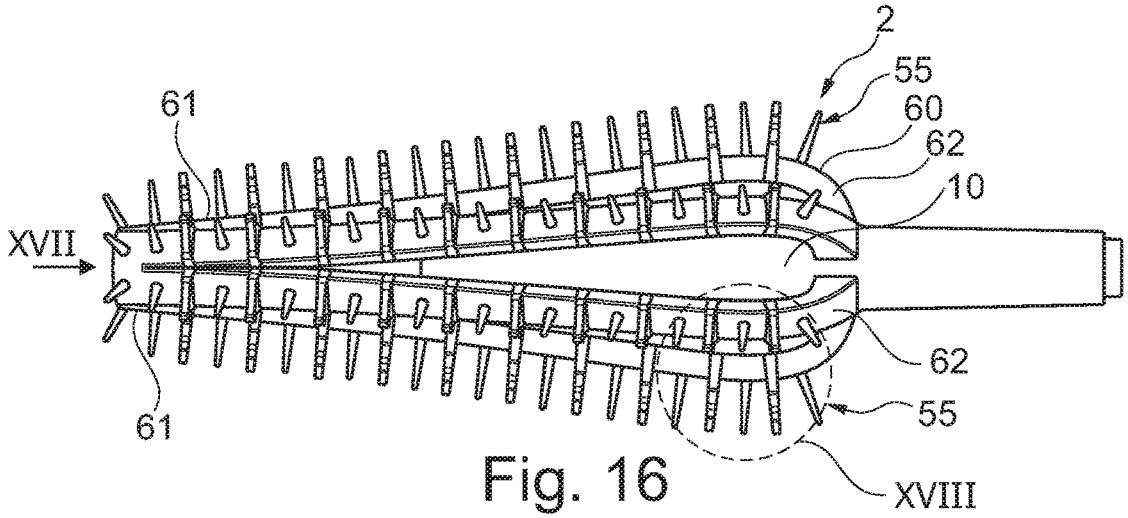
FIG. 16 is a schematic and partial side view of an applicator produced in accordance with the invention.
Figure 17:
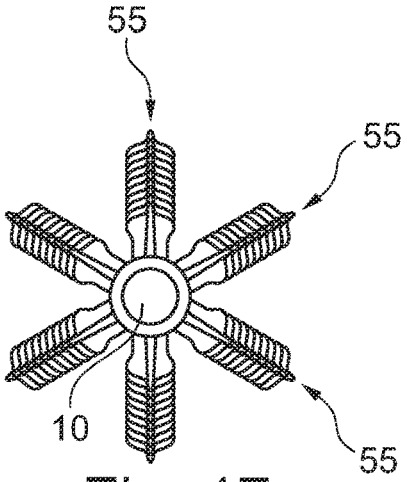
FIG. 17 is a front view of the applicator of FIG. 16 according to arrow XVII.
Figure 18:
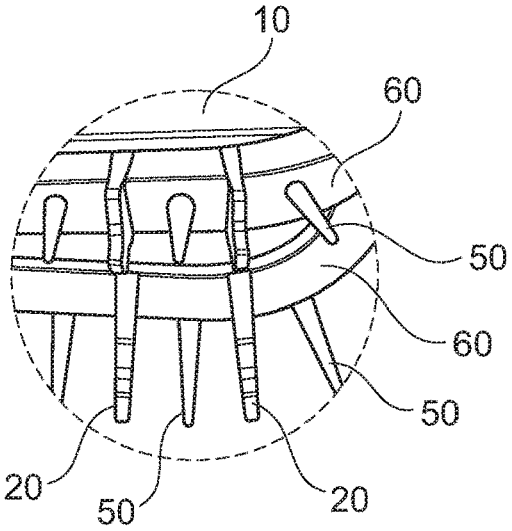
FIG. 18 is a detailed view XVIII of the applicator of FIG. 16.
Figure 19:
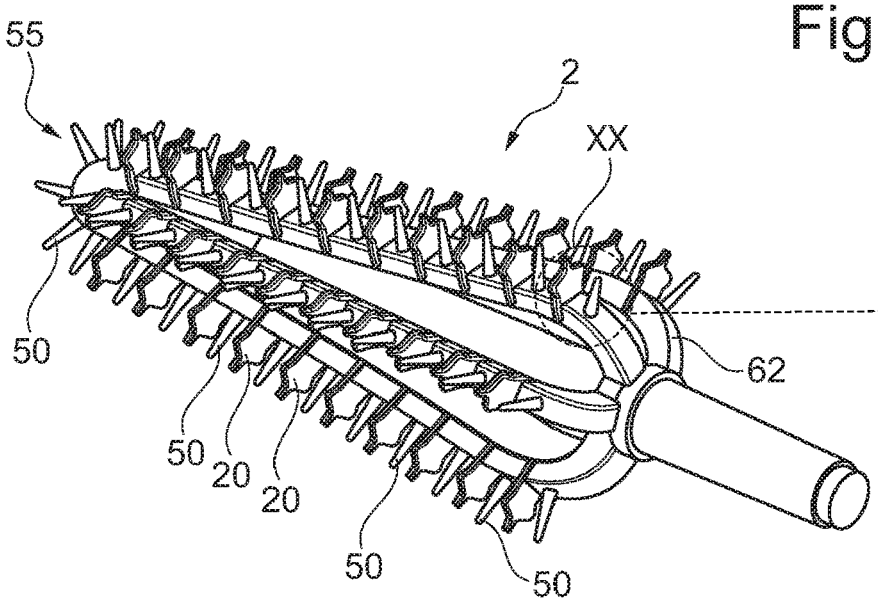
FIG. 19 is a view in perspective of the applicator of FIG. 16.

In the variant shown in FIG. 15, the teeth 20 are provided at their free end 26 with rounded heads 34, for example formed by melting the material of the teeth.

The invention is not limited to the exemplary embodiments which have just been described, the characteristics of which may be combined with one another as parts of variants which are not illustrated.

In the examples described above, the rectilinear portions of the edges 24, 25 are parallel to one another in the bottom part 21 of the teeth 20. In a variant which is not illustrated, the rectilinear portions of the edges 24, 25 are not parallel to one another, and converge towards or diverge away from one another in the direction of the free end 26 of the teeth 20.

The applicator member may have spikes which may be positioned between the teeth. In the embodiment illustrated in FIGS. 16 to 20, the teeth 20 and the spikes 50 are disposed in a row 55 of teeth 20 and spikes 50 in an alternate manner. In a row, each tooth 20 succeeds to a spike 50 and each spike 50 to a tooth 20, with the exception of the spikes of the end of the row 55.

Furthermore, in this embodiment, the teeth 20 extend from branches 60 which are relied to the core 10 at each of their ends 61 and 62. The applicator comprises six branches each carrying a row of teeth and spikes as described above. A branch carries around 10 teeth 20 and around 12 spikes 50.

Figure 20:
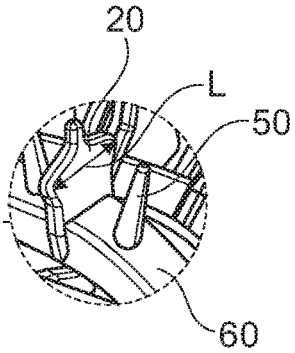
FIG. 20 is a detailed view of XX of the applicator of FIG. 19.

Moreover, in this embodiment, the width L of a tooth 20 in the bottom part of said tooth is strictly inferior to the greatest width of said tooth 20, that is to say the width L of the tooth 20 decreases towards the base of the tooth, as shown on FIG. 20.

The applicator member may be able to vibrate, that is to say that vibrations may be applied to it during application, combing or picking up of the product.

In a variant, the applicator member may be able to rotate, that is to say that it may be made to carry out a rotational movement about the longitudinal axis of the core, for example during application, combing of the eyelashes or the picking up of the product.

In a further variant, the applicator member is heated, that is to say it may have a heating element for heating the eyelashes and/or eyebrows, and/or the teeth and/or the core of the applicator member.

The applicator member may also be able to vibrate and/or able to rotate and/or be heated.

The teeth may have a roughness or may undergo a chemical or mechanical treatment that promotes sliding on the eyelashes or eyebrows.

The teeth may comprise a material having bacteriostatic properties and/or a magnetic material.

The expression "having a" should be understood as being synonymous with "having at least one", and "between" is understood as including the limits, unless specified to the contrary.

The invention claimed is:

1. Applicator for applying a product to the eyelashes and/or eyebrows, having a molded applicator member, this applicator member having:

a core that extends along a core longitudinal axis, and teeth carried by the core, and situated all around the core, each tooth extending along a longitudinal axis the teeth being disposed in at least three longitudinal rows circumferentially surrounding the core and distributed equally around the core, wherein each tooth having a symmetric shape in a front view corresponding to a front view of a plane defined by the tooth longitudinal axis and a cross-sectional axis of the tooth, wherein the cross sectional axis of the tooth defines its greatest width, each tooth having a bottom part and a top part, each top part corresponding to an upper half of the respective tooth, equal to half a height of the tooth along the longitudinal axis of the tooth, the top part defining a free end of the tooth opposite to the core, the greatest width of the tooth being located in the bottom part of the tooth, the teeth narrowing only in their top part in the front view towards their free end, each tooth having at least two opposite edges that meet at its free end, each opposite edge having a point of inflection, the points of inflection of the opposite edges having a same axial position along the longitudinal axis of the tooth, and being located in the top part of the tooth, and an angle formed between the tangent, at each point of inflection, to the curve followed by each opposite edge of the tooth of the teeth having the point of inflection and the longitudinal axis of the tooth extends being the same for all the points of inflection.

2. Packaging and application device for applying a product to the eyelashes and/or eyebrows, having an applicator as defined in claim 1 and a container containing the product to be applied to the eyelashes and/or eyebrows with the aid of the applicator.

3. Applicator for applying a product to the eyelashes and/or eyebrows, having a molded applicator member, this applicator member having:

a core that extends along a core longitudinal axis, and teeth extending from a series of branches, the branches extending between ends, the ends being connected to the core, the branches circumferentially surrounding the core and only contacting the core at its distal and proximal ends, each tooth extending along a longitudinal axis, each tooth having a symmetric shape in a front view corresponding to a front view of a plane defined by the tooth longitudinal axis and a cross-sectional axis of the tooth, wherein the cross sectional axis of the tooth defines its largest cross-sectional dimension, each tooth having a bottom part and a top part, each top part corresponding to an upper half of the respective tooth, equal to half a height of the tooth along its longitudinal axis, the top part defining a free end of the tooth opposite to the core, the teeth narrowing only in their top part in the front view towards their free end, each tooth having at least two opposite edges that meet at its free end, each opposite edge of each tooth having a point of inflection, the points of inflection of the opposite edges of each tooth having a same axial position along the longitudinal axis of the tooth, and being located in the top part of the tooth, and for each tooth, an angle formed between the tangent, at each point of inflection, to a curve followed by each opposite edge of the tooth of the teeth having the point of inflection and the longitudinal axis of the tooth being the same for all the points of inflection.

4. Applicator according to claim 1, wherein each tooth has an elongate shape in a flattening plane defined by its tooth longitudinal axis and its tooth cross-sectional axis.

5. Applicator according to claim 1, wherein the angle formed between the tangent, at each point of inflection of the tooth of the teeth, to the curve followed by each opposite edge of the tooth of the teeth having the point of inflection and the longitudinal axis along which the tooth extends is between 30° and 80°.

6. Applicator according to claim 1, wherein the teeth have a variable height.

7. Applicator according to claim 1, wherein the teeth become thinner towards their free end.

8. Applicator according to claim 1, wherein each tooth has a height less than or equal to 5 mm.

9. Applicator according to claim 4, wherein the flattening plane of the teeth forms an angle of between 60° and 120° with the core longitudinal axis.

10. Applicator according to claim 4, wherein the flattening plane of the teeth forms a zero angle with the core longitudinal axis.

11. Applicator according to claim 9 wherein the flattening plane is perpendicular to the core longitudinal axis.

12. Applicator according to claim 3, wherein each branch carries a row of the teeth.

13. Applicator according to claim 3, wherein the applicator has spikes that are positioned between the teeth, each branch carrying a row of teeth and spikes.

* * * * *